US009326560B2

(12) United States Patent
Lanez

(10) Patent No.: US 9,326,560 B2
(45) Date of Patent: May 3, 2016

(54) SAFETY HELMET WITH IMPROVED LINER AND CHINSTRAP

(71) Applicant: ZEDEL, Crolles (FR)

(72) Inventor: Raphael Lanez, Crolles (FR)

(73) Assignee: ZEDEL, Crolles (FR)

( * ) Notice: Subject to any disclaimer, the term of this patent is extended or adjusted under 35 U.S.C. 154(b) by 318 days.

(21) Appl. No.: 14/061,120

(22) Filed: Oct. 23, 2013

(65) Prior Publication Data

US 2014/0109297 A1 Apr. 24, 2014

(30) Foreign Application Priority Data

Oct. 23, 2012 (FR) ..... 12 02825

(51) Int. Cl.
*A42B 3/04* (2006.01)
*A42B 3/14* (2006.01)
*A42B 3/08* (2006.01)

(52) U.S. Cl.
CPC ... *A42B 3/14* (2013.01); *A42B 3/04* (2013.01); *A42B 3/0406* (2013.01); *A42B 3/08* (2013.01)

(58) Field of Classification Search
CPC ..... A42B 3/147; A42B 3/04; A42B 3/0406; A42B 3/08; A42B 3/085; A42B 3/14; A42B 3/145; Y10T 24/45215; Y10T 24/4035; Y10T 24/4044; Y10T 24/4047; Y10T 24/2192; Y10T 24/26; Y10T 24/268; Y10T 24/3401; Y10T 24/3403; Y10T 24/3405; Y10T 24/3409; Y10T 24/342; Y10T 24/4019; Y10T 24/4091; Y10T 24/44017; Y10T 24/44026; Y10T 24/44043; Y10T 24/44128
See application file for complete search history.

(56) References Cited

U.S. PATENT DOCUMENTS 3,087,164 A * 4/1963 Gilbert ..... A42B 3/14 2/419
3,092,837 A * 6/1963 Austin ..... A42B 3/145 2/183
3,154,788 A * 11/1964 Simpson ..... A42B 3/145 2/418
3,491,414 A * 1/1970 Stoffel ..... A44B 11/2523 24/632
3,497,873 A * 3/1970 Benner ..... A42B 3/14 2/414
3,555,560 A * 1/1971 Rascke ..... A42B 3/14 2/416
3,633,214 A * 1/1972 Newcomb ..... A42B 3/14 2/418
3,852,822 A * 12/1974 Watkins ..... A42B 3/14 2/417

(Continued)

FOREIGN PATENT DOCUMENTS

DE 299 14 894 U1 2/2001
EP 0 553 037 A1 7/1993

(Continued)

*Primary Examiner* — Danny Worrell
*Assistant Examiner* — Khaled Annis
(74) *Attorney, Agent, or Firm* — Oliff PLC

(57) ABSTRACT

A safety helmet has a protective shell, an inner liner with several attachment branches, and at least a first securing clip to fit an accessory on the outer surface of the shell. Each attachment branch of the liner comprises a fixing part inserted and blocked in a slide of the shell by said first securing clip which acts both as latch to attach the liner to the shell and as female loop for clipping of a second securing clip connected to a chinstrap.

3 Claims, 6 Drawing Sheets

(56) References Cited

U.S. PATENT DOCUMENTS 3,909,846 A 10/1975 Zahn
4,055,860 A * 11/1977 King ..... A42B 3/14 2/416
4,463,456 A * 8/1984 Hanson ..... A42B 3/14 2/416
4,559,679 A * 12/1985 Downey ..... A42B 3/08 2/421
4,888,831 A * 12/1989 Oleson ..... A42B 3/145 2/420
5,079,780 A * 1/1992 Coombs ..... A42B 3/08 2/420
5,113,534 A * 5/1992 Lane ..... A42B 3/145 2/416
5,118,104 A * 6/1992 DeLanzo ..... A63B 69/0002 273/DIG. 17
5,121,508 A * 6/1992 Grilliot ..... A42B 3/14 2/421
5,150,479 A * 9/1992 Oleson ..... A42B 3/14 2/414
5,898,949 A * 5/1999 Barthold ..... A42B 3/14 2/411
6,076,237 A * 6/2000 Goorhouse ..... A44B 11/263 24/200
6,081,931 A * 7/2000 Burns ..... A42B 3/14 2/411
6,226,844 B1 * 5/2001 Lerra ..... A44B 11/006 24/615
6,317,895 B1 * 11/2001 Erth ..... A42B 3/06 2/411
2002/0116749 A1 * 8/2002 Bielefeld ..... A42B 3/14 2/416
2008/0141504 A1 * 6/2008 Wright ..... A44B 11/266 24/592.11
2009/0044316 A1 * 2/2009 Udelhofen ..... A42B 3/20 2/424
2009/0064466 A1 * 3/2009 Henderson ..... A44B 11/2549 24/190
2009/0222978 A1 * 9/2009 Fang ..... A42B 3/085 2/421
2010/0011542 A1 * 1/2010 Badrenas Buscart ..... A44B 11/266 24/163 R
2010/0115736 A1 * 5/2010 Paik ..... A44B 11/005 24/163 R
2011/0006178 A1 * 1/2011 Cheng ..... B62J 7/08 248/213.2

FOREIGN PATENT DOCUMENTS

FR 2 228 446 12/1974
WO WO 2005/027671 A1 3/2005
WO WO 2012/104572 A1 8/2012

* cited by examiner

SAFETY HELMET WITH IMPROVED LINER AND CHINSTRAP

BACKGROUND OF THE INVENTION

The invention relates to a safety helmet comprising a shell made from shock-resistant material, an inner liner with several attachment branches, and at least a first securing clip to fit an accessory on the outer surface of the shell.

STATE OF THE ART

The document EP0553037 describes a safety helmet equipped with parts for fixing an accessory formed by a strap of a system for securing a headlamp. Each fixing part is in the form of a grip fitted by clipping from the outside in an opening of the shell. The flexible outer wing of the grip is designed to receive and secure the strap.

Chinstraps are generally attached in fixed manner to the inner wall of the shell. To replace or perform maintenance on the latter, the liner or headband has to be completely or partially dismantled.

Certain known helmets have removable chinstraps, but they are generally attached on the headband which is flexible, and not on the rigid shell. Such helmets no longer comply with the new safety standards.

OBJECT OF THE INVENTION

The object of the invention consists in providing a helmet having a liner secured to the shell by the clip of the external accessory, and a chinstrap that is easily removable without modifying the attachment points of the liner.

The helmet according to the invention is characterized in that each attachment branch of the liner comprises a fixing part inserted and blocked in a slide of the shell by said first securing clip, which acts both as latch to attach the liner to the shell and as female loop for clipping of a second securing clip connected to a chinstrap.

According to a preferred embodiment, the second securing clip is arranged so as to form counter-locking means of the fixing part in the slide, and a removable attachment element of the chinstrap.

The first securing clip is preferably composed of an outer part for fitting the accessory and an inner part inserted through a first aperture of the shell, said inner part having clipping pins forming the latch, and a second aperture forming the female loop.

According to another feature of the invention, the second securing clip comprises a flexible tab biased by elasticity to the locked position after it has been inserted in the first securing clip.

Such a helmet structure enables the liner to be made from moulded plastic, but any other material can be used, in particular from a strap equipped with overmoulded end-parts.

BRIEF DESCRIPTION OF THE DRAWINGS

Other advantages and features will become more clearly apparent from the following description of an embodiment of the invention given for non-restrictive example purposes only and represented in the appended drawings, in which.

DETAILED DESCRIPTION OF THE INVENTION

Figure 1:
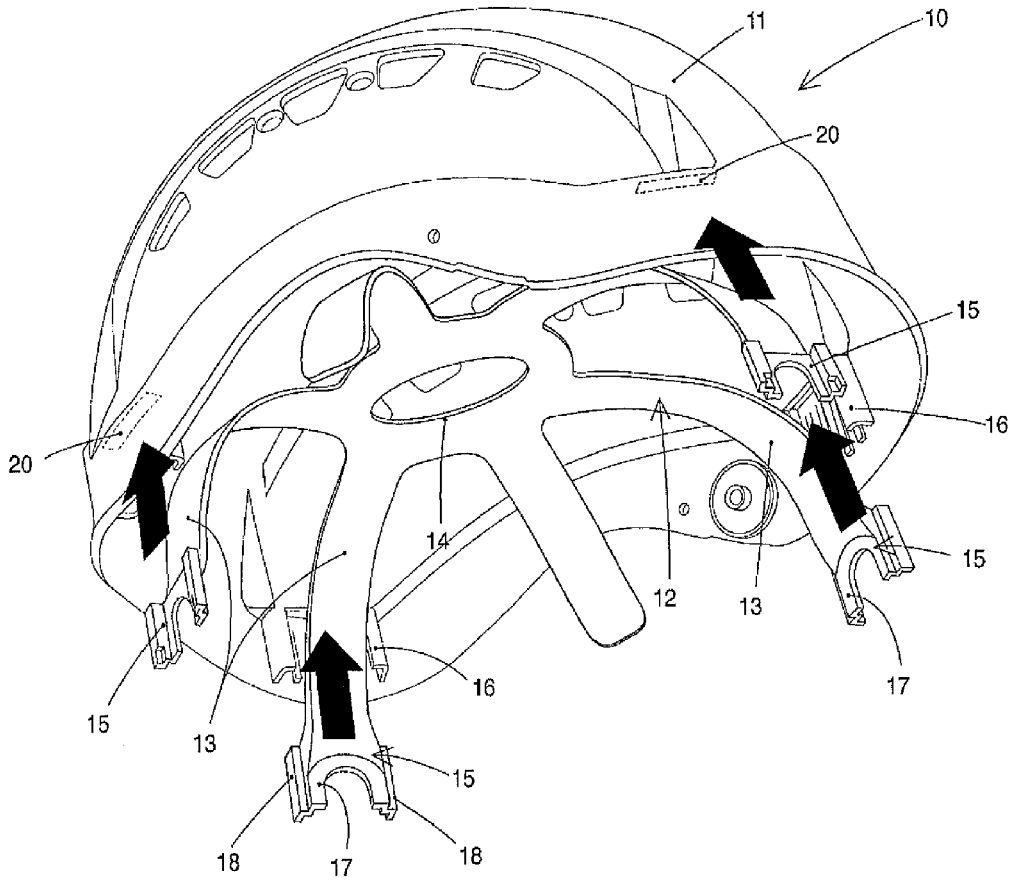
FIGS. 1-1A illustrate views of the shell and of the inner liner of a helmet according to the invention, the headband and neckband not being represented.
Figure 1A:
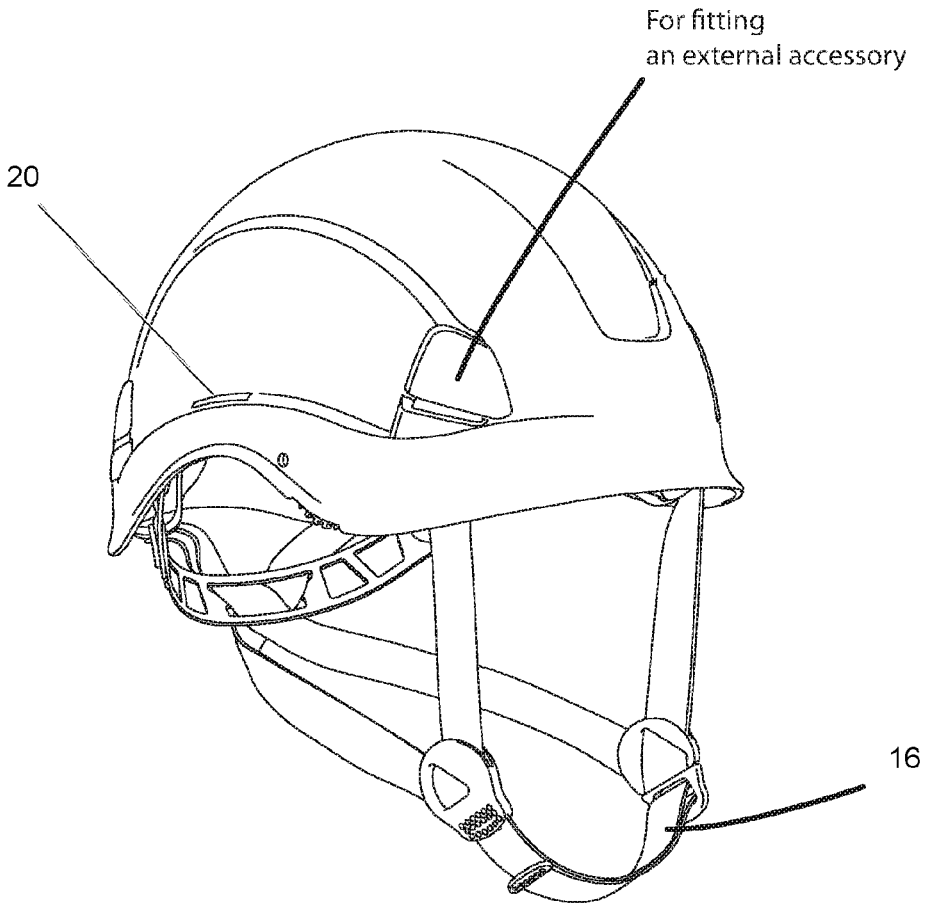

In FIGS. 1-1A, a safety helmet 10 comprises an outer shell 11 in the form of a shock-resistant crown, and an inner liner 12 attached to shell 11 by securing means. Shell 11 can be made from rigid or flexible plastic material, and flexible liner 12 is arranged to snugly follow the shape of the user's head. Liner 12 comprises several curved attachment branches 13 joined at regular intervals to an upper washer 14 of annular shape. For example purposes, liner 12 of FIG. 1 is provided with six attachment branches 13. It is clear that a different number of branches 13 can be used to constitute liner 12.

The adjustable headband and the chinstrap are not represented in FIG. 1 for the sake of clarity of the drawing.

Figure 2A:
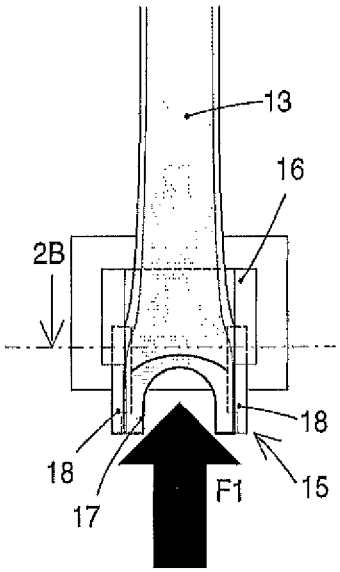
FIGS. 2A and 2C shows views of a fixing part of a branch of the liner, respectively at the beginning and end of insertion in a slide of the shell.
Figure 2C:
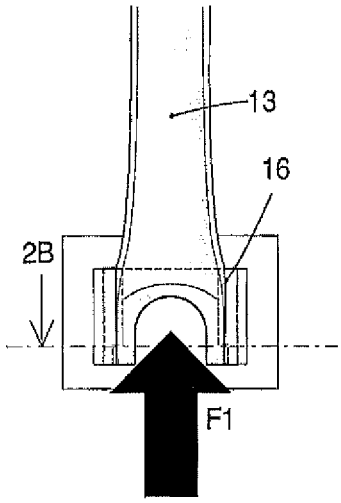
Figure 2B:
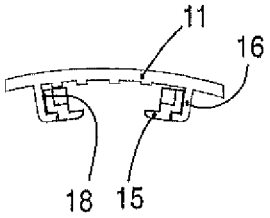
FIG. 2B illustrates a cross-sectional view along the line 2B-2B of FIG. 2A.

The securing means of liner 12 comprise securing elements provided at the ends of four branches 13 located opposite washer 14 and designed to be inserted in slides 16 arranged around the inner peripheral surface of shell 11. Fixing part 15 of each branch 13 comprises a securing notch 17 in the shape of a reversed U, which is framed by a pair of guiding ribs 18 which fit into the corresponding slide 16 when liner 12 is fitted in place. The distance between the two ribs 18 is slightly smaller than the width of slide 16 to enable insertion by sliding (arrow F1) of securing elements, as illustrated in FIGS. 2A-2C. This results in prepositioning of liner 12 inside shell 11.

Figure 3A:
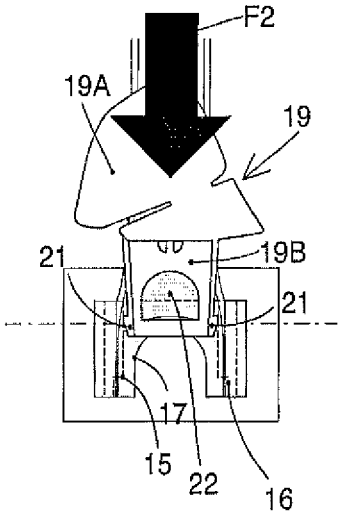
FIGS. 3A and 3C show views of the first securing clip respectively at the beginning and end of insertion on the fixing part.
Figure 3C:
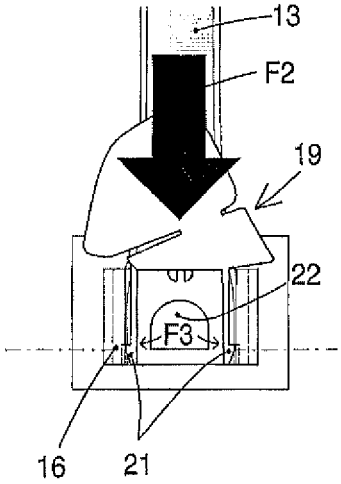
Figure 3B:
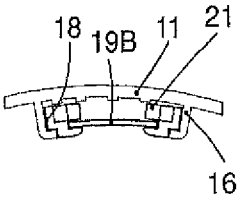
FIGS. 3B and 3D are cross-sectional views along the lines 3B-3B and 3D-3D of FIGS. 3A and 3C.
Figure 3D:
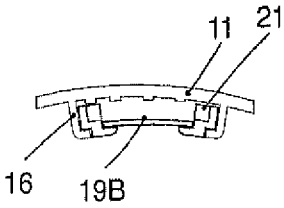
Figure 4A:
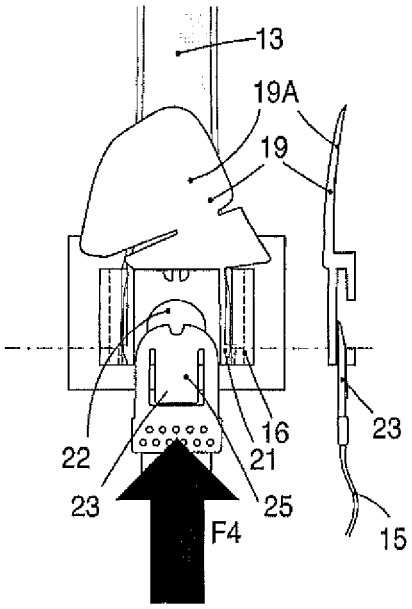
FIGS. 4A, 4C, and 4E show views of the second securing clip respectively at the beginning and end of insertion for counter-locking of the fixing part.
Figure 4C:
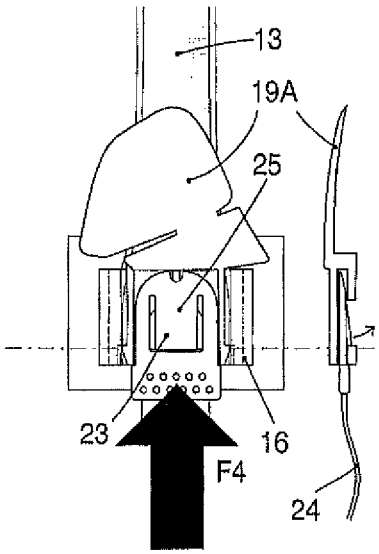
Figure 4B:
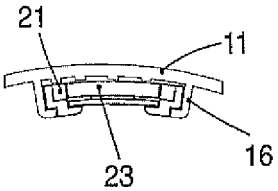
FIGS. 4B and 4D are cross-sectional views along the lines 4B-4B and 4D-4D of FIGS. 4A and 4C.
Figure 4D:
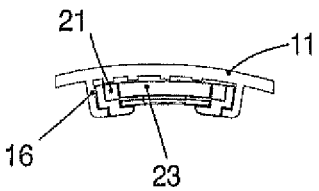
Figure 4E:
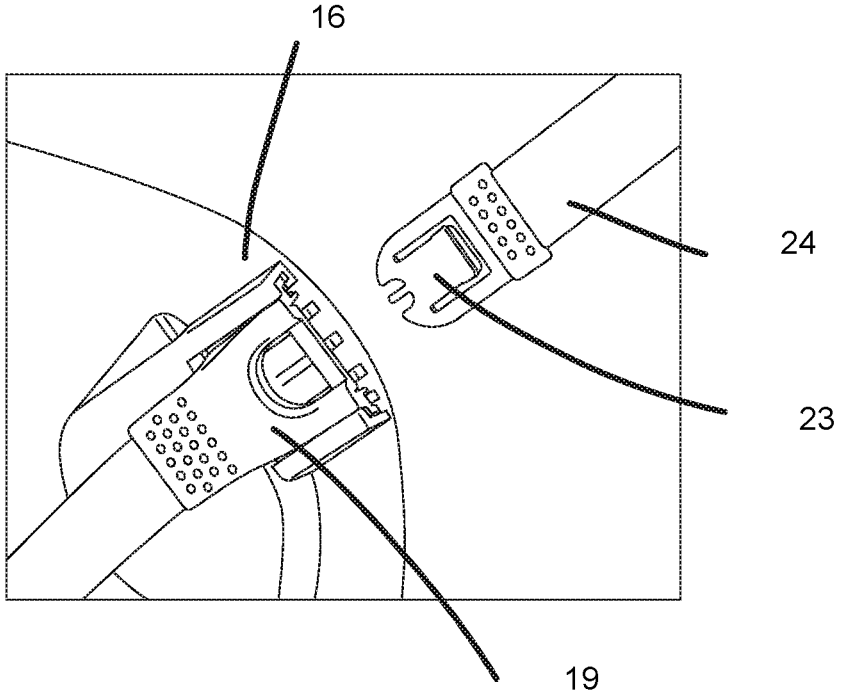

With reference to FIGS. 3A-3D, blocking of each fixing part 15 in the corresponding slide 16 is obtained by means of a first securing clip 19 acting at the same time as fixing part for an external accessory (not shown), in particular the system for securing a lighting lamp fitted around shell 11. First securing clip 19 is inserted from outside by downwards translation (arrow F2) through a first aperture 20 of shell 11 (see FIG. 1). In the fitting position, first securing clip 19 is composed of an outer part 19A enabling the external accessory to be fitted, and of an inner part 19B having clipping pins 21 which block fixing part 15 in slide 16. FIG. 3C shows the distance between clipping pins 21 at the end of insertion travel of securing clip 19, the first aperture provides an external access to release the external accessory that is disposed upon an outer surface of the shell.

Inner part 19B of first securing clip 19 further comprises a second aperture 22 arranged between the two clipping pins 21. This second aperture 22 presents a similar profile to that of notch 17 of fixing part 15, but of smaller dimension. At the end of insertion travel (FIG. 3C), second aperture 22 is positioned facing notch 17 of fixing part 15.

FIGS. 4A-4E represent an additional locking of fixing part 15 in slide 16 by upward insertion (arrow F4) of a second securing clip 23 between the two clipping pins 21 of first clip 19. Second securing clip 23 is advantageously connected to a chinstrap 24 so as to act both as counter-locking means of fixing part 15 of liner 12 and as removable attachment element of chinstrap 24.

Second securing clip 23 is equipped with a flexible tab 25 biased by elasticity to a locked position against a cross-member delineating second aperture 22. To remove chinstrap 24, a pressure simply has to be exerted on tab 25 to actuate it to the unlocked position. Second securing clip 23 can then be extracted from first securing clip 19 and from slide 16.

Liner 12 is advantageously made from plastic, and first securing clip 19 acts as a latch to attach and secure liner to shell 11, while at the same time acting as female loop for second securing clip 23 connected to chinstrap 24. The latter can thus be easily removed without modifying the securing elements of liner 12. Such a helmet is in compliance with safety standards.

Instead of being made from plastic, it is also possible to achieve liner 12 by means of straps, in particular made from textile, equipped with the same securing elements.

The invention claimed is:

1. A safety helmet comprising:

a shell made from shock-resistant material; having a thickness extending from an outer surface to an inner surface when the helmet is worn, an inner liner with several attachment branches, and at least a first securing clip having (i) an outer part for fitting an external accessory upon the outer surface of the shell, and (ii) an inner part inserted through a first aperture of the shell extending along the entire thickness of the shell, and being provided with clipping pins, wherein the first aperture is visible from an exterior of the safety helmet, wherein each attachment branch of the liner comprises a fixing part inserted in a slide of the shell, and being blocked in said slide of the shell by said clipping pins, said inner part of the first securing clip further comprising a second aperture forming a female loop for clipping of a second securing clip connected to a chinstrap, said second securing clip being arranged so as to form counter-locking means of the fixing part in the slide, and a removable attachment element of the chinstrap;

wherein the first aperture exits to the outer surface of the shell, and wherein the first securing clip is inserted from the outside surface of the shell by downwards translation into the first aperture and the second securing clip engages the first securing clip through an upward translation from the inner surface of the shell;

wherein the first aperture provides an exterior access to release the external accessory that is disposed upon the outer surface of the shell.

2. The safety helmet according to claim 1, wherein the second securing clip comprises a flexible tab biased by elasticity to the locked position after it has been inserted in the first securing clip.

3. The safety helmet according to claim 1, wherein the chinstrap is removable after the second securing clip has been removed without detaching the liner from the shell.

* * * * *